United States Patent [19]

Langner

[11] 4,291,748

[45] Sep. 29, 1981

[54] DUMMY BAR FOR A CONTINUOUS CASTING MACHINE

[75] Inventor: Carl Langner, Monsey, N.Y.

[73] Assignee: Concast Incorporated, Montvale, N.Y.

[21] Appl. No.: 124,059

[22] Filed: Feb. 25, 1980

[51] Int. Cl.[3] ..... B22D 11/08

[52] U.S. Cl. ..... 164/426; 164/446

[58] Field of Search ..... 164/426, 446

[56] References Cited

U.S. PATENT DOCUMENTS

| | | | |
|---|---|---|---|
| 3,344,844 | 10/1967 | Reinfeld et al. | 164/426 |
| 3,351,124 | 11/1967 | Hess | 164/426 |
| 3,370,641 | 2/1968 | Greenberger | 164/426 X |
| 3,374,828 | 3/1968 | Menu . | |
| 3,426,835 | 2/1969 | Michelson | 164/426 |
| 3,433,287 | 3/1969 | Greenberger | 164/426 |
| 3,495,651 | 2/1970 | Rokop et al. | 164/426 |
| 3,930,533 | 1/1976 | Rokop et al. | 164/426 |
| 4,043,383 | 8/1977 | Isenberg et al. | 164/426 |

FOREIGN PATENT DOCUMENTS

| | | | |
|---|---|---|---|
| 1219068 | 1/1971 | United Kingdom | 164/426 |

*Primary Examiner*—Robert D. Baldwin
*Assistant Examiner*—J. Reed Batten, Jr.
*Attorney, Agent, or Firm*—Tobias Lewenstein

[57] ABSTRACT

A continuous casting machine for billets and blooms has a curved mold which is followed by a curved cooling zone and a straightener. A dummy bar for the casting machine has a length at least equal to the distance between the mold and the straightener. The dummy bar has a rigid portion and a flexible portion which are pivotally connected with one another. The rigid portion, which is curved and has a radius equal to the casting radius, includes a dummy bar head. The flexible portion is made up essentially of pivotally connected, curved links having radii equal to the casting radius. The flexible portion is designed such that it can assume radii equal to or less than the casting radius. When the dummy bar is in position for casting, the flexible portion assumes the casting radius and the dummy bar conforms to the curvature of the casting machine. Since the rigid portion of the dummy bar need not be supported in this position, less support structure between the mold and the straightener is required than for a dummy bar which is flexible in its entirety. When the dummy bar is not in use, it is stored with the flexible portion thereof bent to a radius much smaller than the casting radius. The dummy bar thus takes up less space in storage than a dummy bar which conforms to the curvature of the casting machine and is rigid in its entirety.

20 Claims, 10 Drawing Figures

FIG. 7
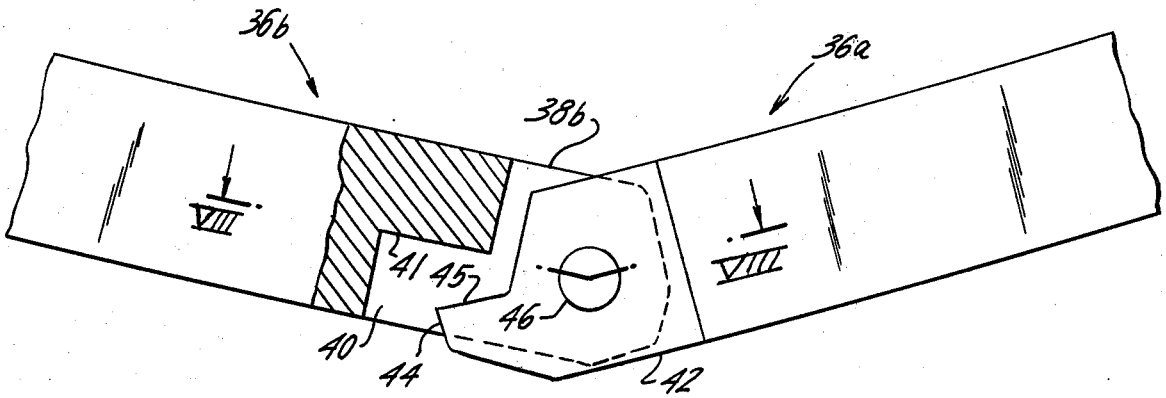
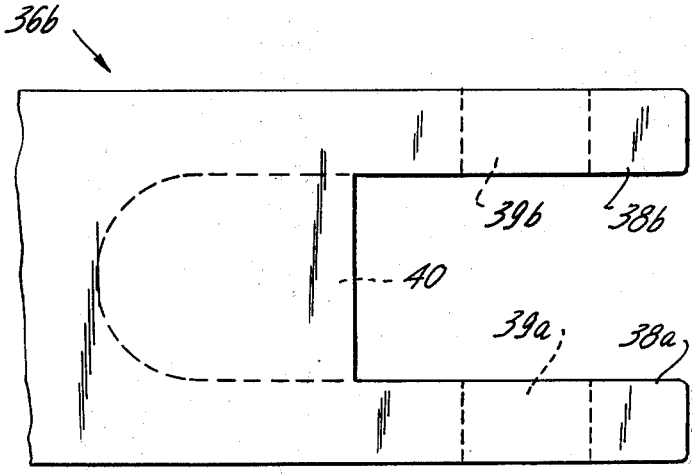
FIG. 6
FIG. 8
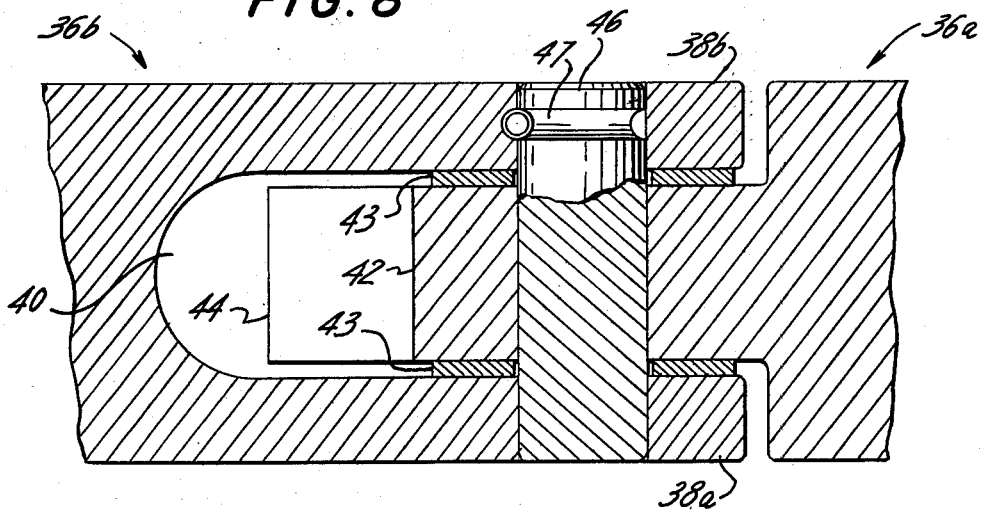

DUMMY BAR FOR A CONTINUOUS CASTING MACHINE

FIELD OF THE INVENTION

The invention relates generally to the continuous casting of metals, e.g. steels.

More particularly, the invention is concerned with the dummy bar which is used to start a continuously cast metal strand.

BACKGROUND OF THE INVENTION

A conventional type of installation for the continuous casting of metals includes a generally vertical, cooled, open-ended mold in which a metal strand is continuously formed. The mold is followed by a secondary cooling zone which is at least partially curved so as to turn the strand towards the horizontal. A straightener is arranged behind the secondary cooling zone and straightens the strand which subsequently follows a horizontal roller table to a cutting unit where it is cut into sections. The cut sections travel along another roller table, known as a runout table, to a cooling bed or to a mill.

One type of dummy bar for starting the withdrawal of the strand from the mold extends from the latter to the straightener when positioned in readiness for casting. The straightener draws the dummy bar away from the mold and thus also serves as a withdrawal device. Once the strand has reached the straightener, the dummy bar and the strand are disconnected and the dummy bar is stored.

An early dummy bar is made up essentially entirely of pivotally connected links which are short as compared to the distance between the mold and the straightener. Dummy bars of this type are flexible and can be stored flat yet have the ability to bend to the curvature of the secondary cooling zone. This early link design has several disadvantages.

To begin with, dummy bars of this design require a great deal of maintenance to insure that the links remain freely pivotable relative to one another. Furthermore, due to their flexibility, these link-type dummy bars must be supported along the entire span between the mold and the straightener when positioned in readiness for casting. This requires a large support structure which adds to the cost of the casting machine. In addition, dummy bars of this type cause non-uniform withdrawal of the strand from the mold since they tend to flex downwardly into the spaces between adjacent rollers of the roller tables following the straightener. Moreover, since the link-type dummy bars are normally stored in a flat condition, a long storage area is required thereby increasing the cost of the casting machine and the space requirements for the latter. This is particularly true for billet casting machines where the dummy bars are stored alongside the runout tables so that these tables must have lengths at least equal to those of the dummy bars.

In order to provide for a more uniform withdrawal of the strand from the mold, it has been proposed to construct the link-type dummy bars with limited flexibility. Here, the dummy bars are free to bend in one direction but can bend back only until they are flat. This prevents the dummy bars from flexing downwardly into the spaces between adjacent rollers of the roller tables and consequently promotes a more uniform withdrawal of the strand from the mold.

Another proposal eliminates the problem of non-uniform withdrawal as well as that of a long storage space. According to this proposal, the dummy bar is raised after leaving the straightener and is passed over a group of rollers located at the level of the casting platform. The rollers define an arc of radius smaller than the casting radius and a central portion of the dummy bar rests on the rollers while the remainder of the dummy bar is suspended on either side thereof. The dummy bar thus has an inverted U-shaped configuration while in storage. The dummy bar is here composed of curved links having radii equal to the casting radius so that the dummy bar conforms closely to the curvature of the casting machine when in the casting position.

The latter proposal does result in reduced storage space requirements for the dummy bar and also eliminates the problem of non-uniform withdrawal since the dummy bar does not travel onto the roller tables. However, the maintenance problems associated with the link-type dummy bars remain as does the need for a support structure along the entire span between the mold and the straightener.

A further proposal has been presented for curved-mold casting machines designed to cast strands such as billets of relatively small cross-sectional area. Here, a rigid, curved dummy bar is used which has a radius equal to the casting radius. The length of the dummy bar is somewhat greater than the distance between the mold and the straightener so that one end of the dummy bar can close the lower end of the mold while the other end is engaged by the straightener. This design eliminates the maintenance problems associated with the link-type dummy bars and has the further advantage that reduced support structure is required between the mold and the straightener.

The rigid dummy bar is stored behind the straightener in a storage unit which defines a curved path having a radius equal to the casting radius and hence to that of the dummy bar. This path forms a continuation of the casting path and the dummy bar enters the storage unit immediately after leaving the straightener. In its stored position, the dummy bar curves towards a location above the straightener.

Due to the relatively great length of the dummy bar, the latter projects upwardly to a level above that of the casting platform when in storage. This not only causes interference with the movement of the overhead cranes used in mills but also reduces the working space available on the casting platform. In addition, since the dummy bar curves towards a location above the straightener, access to the latter from the casting platform is made difficult. Aside from these disadvantages, the use of a rigid dummy bar leads to problems in the event of distortion of the dummy bar since it may no longer be possible to readily guide the dummy bar into the mold.

The latter disadvantage has been overcome by a dummy bar having limited flexibility. This dummy bar resembles the rigid dummy bar but, as opposed to the rigid dummy bar, is composed of several long links which are connected so as to permit limited, relative pivotal movement thereof. This makes it possible to compensate for minor distortion.

A proposal similar to the rigid dummy bar has been made for straight-mold casting machines in which the secondary cooling zone is not curved in its entirety but is made up of a straight section immediately following the mold and a curved section between the straight section and the straightener. In this case, the dummy bar is composed of a link-type flexible portion and a rigid portion. The flexible portion is designed to close the lower end of the mold prior to the start of a casting operation. It is flexible out of necessity since it must be able to conform to the curvature of the curved section of the secondary cooling zone and also be capable of assuming a linear configuration when in the straight section of this zone. The rigid portion of the dummy bar is curved and has a radius equal to the casting radius. This portion of the dummy bar is located in the curved section of the secondary cooling zone at the beginning of a casting operation and is engaged by the straightener.

The storage scheme set forth for the part-rigid, part-flexible dummy bar is the same as that for the rigid dummy bar and leads to the same disadvantages. The part-rigid, part-flexible dummy bar further eliminates one of the advantages of the rigid dummy bar, namely, a reduction in the support structure required between the mold and the straightener. Thus, support for the flexible portion of the part-rigid, part-flexible dummy bar must be provided along the entire span between the mold and the straightener.

OBJECTS OF THE INVENTION

It is an object of the invention to provide a dummy bar for curved-mold casting machines which requires less maintenance and less support structure between the mold and the straightener than flexible, link-type dummy bars yet may be stored so as not to interfere with the movement of overhead cranes as do rigid dummy bars.

Another object of the invention is to provide a dummy bar for curved-mold casting machines which requires less maintenance and less support structure between the mold and the straightener than flexible, link-type dummy bars yet may be stored without affecting the casting platform as do rigid dummy bars.

An additional object of the invention is to provide a dummy bar for curved-mold casting machines which requires less maintenance and less support structure between the mold and the straightener than flexible, link-type dummy bars yet may be stored without affecting access to the straightener as do rigid dummy bars.

SUMMARY OF THE INVENTION

The preceding objects and others are achieved by the invention.

A continuous casting machine according to the invention includes an open-ended mold which is followed by a curved cooling zone and a strand withdrawal device. A dummy bar for the casting machine has a length at least equal to the distance between the mold and the withdrawal device and comprises a rigid portion and a flexible portion. The rigid portion is curved and has a radius equal to the casting radius. The length of the rigid portion is a substantial fraction of the mold-to-withdrawal device distance. The rigid portion has an end which closes the lower end of the mold at the beginning of a casting operation and which is provided with coupling means for permitting a connection to be established between the dummy bar and a continuously cast strand formed in the mold. The flexible portion is capable of bending to a radius substantially smaller than the casting radius.

When the dummy bar is positioned in readiness for casting, the rigid portion extends from the mold for a substantial distance towards the withdrawal device. The flexible portion, which is capable of assuming the casting radius due to its flexibility, extends from the rigid portion towards the withdrawal device.

Inasmuch as the rigid portion of the dummy bar is essentially self-supporting, it requires little, if any, support so that a reduction in support structure is possible as opposed to casting machines having flexible, link-type dummy bars. Furthermore, the dummy bar of the invention does not require as much maintenance as the link-type dummy bars since a portion thereof is rigid and hence maintenance-free to a large degree. In addition, since the rigid portion of the dummy bar is located in the zone immediately following the mold when the dummy bar is positioned in readiness for casting, the molten metal which escapes from a strand in the event of a breakout and which can cause links to weld together has little chance of contacting the flexible portion and thus severely damaging the dummy bar.

When the dummy bar is withdrawn from the casting path, the flexible portion may be bent to a radius substantially smaller than the casting radius thereby permitting the dummy bar to be stored more compactly than a rigid dummy bar. The flexible portion of the dummy bar of the invention also makes it possible to compensate for minor distortion which might otherwise prevent smooth entry into the mold.

In a preferred embodiment, the dummy bar is stored in a curved zone having an inlet region which extends upwardly from and forms a continuation of the curved part of the casting path. Since the dummy bar is here not stored alongside the runout table, it becomes possible to shorten the latter as compared to casting machines having flexible, link-type dummy bars which are stored flat next to the runout tables. This allows considerable cost savings to be realized. Furthermore, the above storage scheme also makes it possible to reintroduce the dummy bar into the casting path almost immediately after a strand being cast has left the straightener. This enables the time between casting operations to be shortened and further enables a strand to be rapidly restarted after a breakout.

The invention is particularly applicable to the billet and bloom machines used in the continuous casting of steel.

BRIEF DESCRIPTION OF THE DRAWINGS

FIG. 6 is an enlarged plan view illustrating details of the flexible portion of the dummy bar which has a link-type design;

FIG. 7 is a partly sectional side view of the joint between a pair of links;

FIG. 8 is a view in the direction of the arrows VIII—VIII of FIG. 7;

Figure 1:
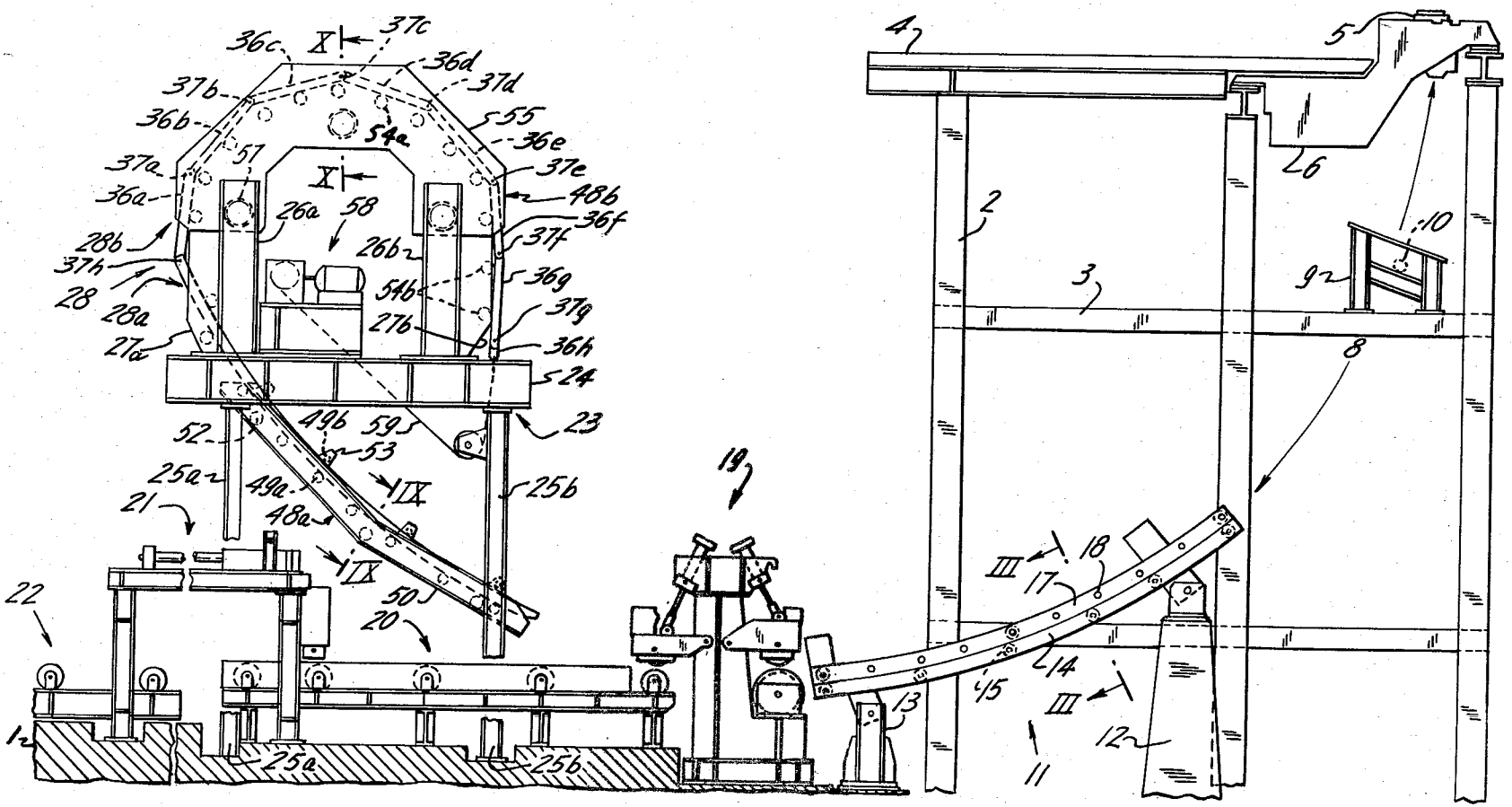
FIG. 1 is a side view of a continuous casting machine having a dummy bar according to the invention.

Referring once more to FIGS. 1 and 2, it may be seen that the flexible portion 28*b* of the dummy bar 28 is composed of a plurality of main links 36*a*–36*g* and a terminal link 36*h*. The links 36*a*–36*h* are pivotally connected with one another via pivot joints 37*a*–37*g*. Another pivot joint 37*h* pivotally connects the flexible portion 28*b* of the dummy bar 28 with the rigid portion 28*a* thereof.

The links 36*a*–36*h* have the same cross-sectional configuration as the arcuate segment 29*a* of the rigid portion 28*a*. Each of the main links 36*a*–36*g* is arcuate and has a radius of curvature equal to the casting radius. The main links 36*a*–36*g* are preferably of equal length while, in order to facilitate guidance of the flexible portion 28*b* during introduction of the dummy bar 28 into its storage unit, the terminal link 36*h* preferably has a much smaller length than the main links 36*a*–36*g*.

The flexible portion 28*b* of the dummy bar 28 is designed such that it can bend to a radius substantially smaller than the casting radius. However, the flexible portion 28*b* is constrained from bending to a radius greater than the casting radius. This constraint is developed by the pivot joints 37*a*–37*h*.

The pivot joints 37*a*–37*h* are identical to one another and the nature thereof is illustrated in FIGS. 6–8 which show the pivot joint 37*a* between the links 36*a* and 36*b*.

Referring first to FIG. 6, it is seen that the end of the link 36*b* adjacent the link 36*a* is formed with a pair of tines 38*a* and 38*b* having passages 39*a* and 39*b*, respectively. In the region behind the tines 38*a* and 38*b*, the link 36*b* is provided with a cutout 40 as also shown in FIG. 7, where the tine 38*a* is broken away, as well as in FIG. 8. This causes an abutment surface 41 to be formed on the link 36*b*.

The end of the link 36*a* adjacent the link 36*b* is formed with a projection 42 which is received between the tines 38*a* and 38*b*. Spacers 43 are arranged between the projection 42 and the respective tines 38*a* and 38*b* to center the projection 42 relative to the tines 38*a* and 38*b*. The projection 42 has a protuberance 44 which is receivable in the cutout 40 provided in the link 36*b*. The protuberance 44 has an abutment surface 45 which is arranged to cooperate with the abutment surface 41 defined by the cutout 40.

The projection 42 and spacers 43 have passages which are aligned with the passages 39*a* and 39*b* in the tines 38*a* and 38*b*. A pivot pin 46 extends through the passages and is locked in position by means of a spring pin 47 thereby pivotally connecting the adjacent links 36*a* and 36*b* to one another.

The abutment surfaces 45 and 41 on the respective links 36*a* and 36*b* bear against one another when the links 36*a* and 36*b* lie on a curve having a radius equal to the casting radius. The abutment surfaces 41 and 45 are so arranged that relative pivotal movement of the links 36*a* and 36*b* beyond this curve, that is, towards larger radii, is prevented. Accordingly, the flexible portion 28*b* of the dummy bar 28 can assume a radius no greater than the casting radius. On the other hand, the links 36*a* and 36*b* are free to undergo relative pivotal movement towards smaller radii, that is, in a direction towards their centers of curvature, thereby permitting the flexible portion 28*b* to assume a radius substantially smaller than the casting radius. upper section 48*b*. The lower and upper sections 48*a* and 48*b* are aligned with one another and with the curved path defined by the mold 5, the cooling zone 8 and the support unit 11. The lower section 48*a* has an inlet end for the dummy bar 28 located closely behind the straightener 19.

The lower section 48*a* of the storage unit is designed to accommodate the rigid portion 28*a* of the dummy bar 28. The lower section 48*a* includes a plurality of support rollers 49*a* as well as several guide rollers 49*b* which cooperate with the support rollers 49*a* to guide the dummy bar 28. The support rollers 49*a* lie on an arc having a radius equal to the casting radius. This arc is so arranged that, if extended towards the straightener 19, it would blend smoothly into the curved path defined by the mold 5, the cooling zone 8 and the support unit 11. The guide rollers 49*b* are situated on an arc corresponding to that for the support rollers 49*a*.

Figure 9:
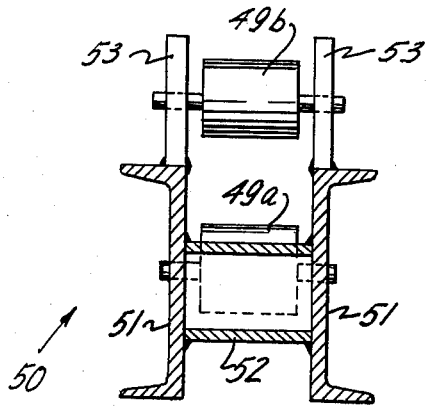
FIG. 9 is a view in the direction of the arrows IX—IX of FIG. 1; and threaded end of the bolt 33 and a nut 35 serves to fix the dummy bar head 29*b* relative to the arcuate segment 29*a*.

All but one of the support rollers 49*a* are journalled in a bearing member 50 which, as seen from FIGS. 1 and 9, is constructed of spaced, parallel, C-shaped beams 51 connected at spaced intervals via stiffening tubes 52. The remaining one of the support rollers 49*a* is journalled in the set of gussets 27*a* mounted on the platform 24 constituting part of the support structure 23 for the storage unit. With one exception, the guide rollers 49*b* are journalled in pairs of opposed, spaced plates 53 which are mounted on the bearing member 50 at spaced intervals along the latter. The mounting of these guide rollers 49*b* is best seen in FIG. 9. The remaining guide roller 49*b* is again journalled in the set of gussets 27*a*.

Figure 10:
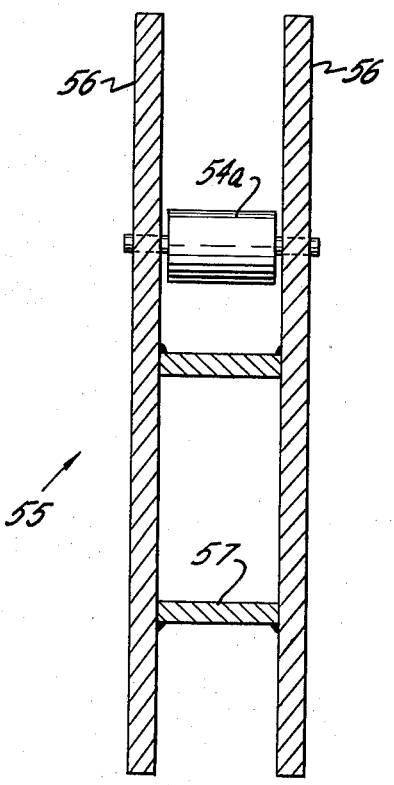

The upper section 48*b* of the storage unit is designed to accommodate the flexible portion 28*b* of the dummy bar 28. The upper section 48*b* comprises a set of support rollers 54*a* as well as guide rollers 54*b* which function to guide the terminal link 36*h* of the dummy bar 28 during the final stages of loading the dummy bar 28 into the storage unit. The guide rollers 54*b* are journalled in the set of gussets 27*b* mounted on the platform 24. On the other hand, the support rollers 54*a* are journalled in a bearing member 55 which, as shown in FIGS. 1 and 10, is constructed of spaced, parallel plates 56 connected at various locations via stiffening tubes 57. The support rollers 54*a* are arranged on an arc having a radius considerably smaller than the radius of the lower section 48*a* and hence considerably smaller than the casting radius. Since the flexible portion 28*b* of the dummy bar 28 is able to conform to the curvature of the arc on which the support rollers 54*a* are situated, the flexible portion 28*b* takes up less room during storage than would be the case if it were rigid.

A drive mechanism 58 is mounted on the platform 24 of the support structure 23 and includes a cable 59 which is permanently connected with the terminal link 36*h* of the dummy bar 28. The drive mechanism 58 functions to draw the dummy bar 28 into the storage unit. It is not necessary for the drive mechanism 58 to be capable of feeding the dummy bar 28 out of the storage unit since the dummy bar 28 and the storage unit may be designed in such a manner that the dummy bar 28 is able to descend from the storage unit by gravity. However, the drive mechanism 58 may function to prevent uncontrolled descent of the dummy bar 28 from the storage unit.

Starting from the condition depicted in FIG. 1, where the dummy bar 28 is located in the storage unit, the operation is as follows:

The dummy bar 28 is lowered from the storage unit and enters the straightener 19 which drives the dummy bar 28 towards the mold 5. During the time that the FIG. 10 is a view in the direction of the arrows X—X of FIG. 1.

DESCRIPTION OF THE PREFERRED EMBODIMENTS

FIG. 1 illustrates a casting machine such as is used, for example, in the continuous casting of steel. The machine of FIG. 1 is mounted on a foundation 1 which carries vertical and horizontal beams 2 and 3, respectively, forming a support structure for a casting platform 4.

Figure 2:
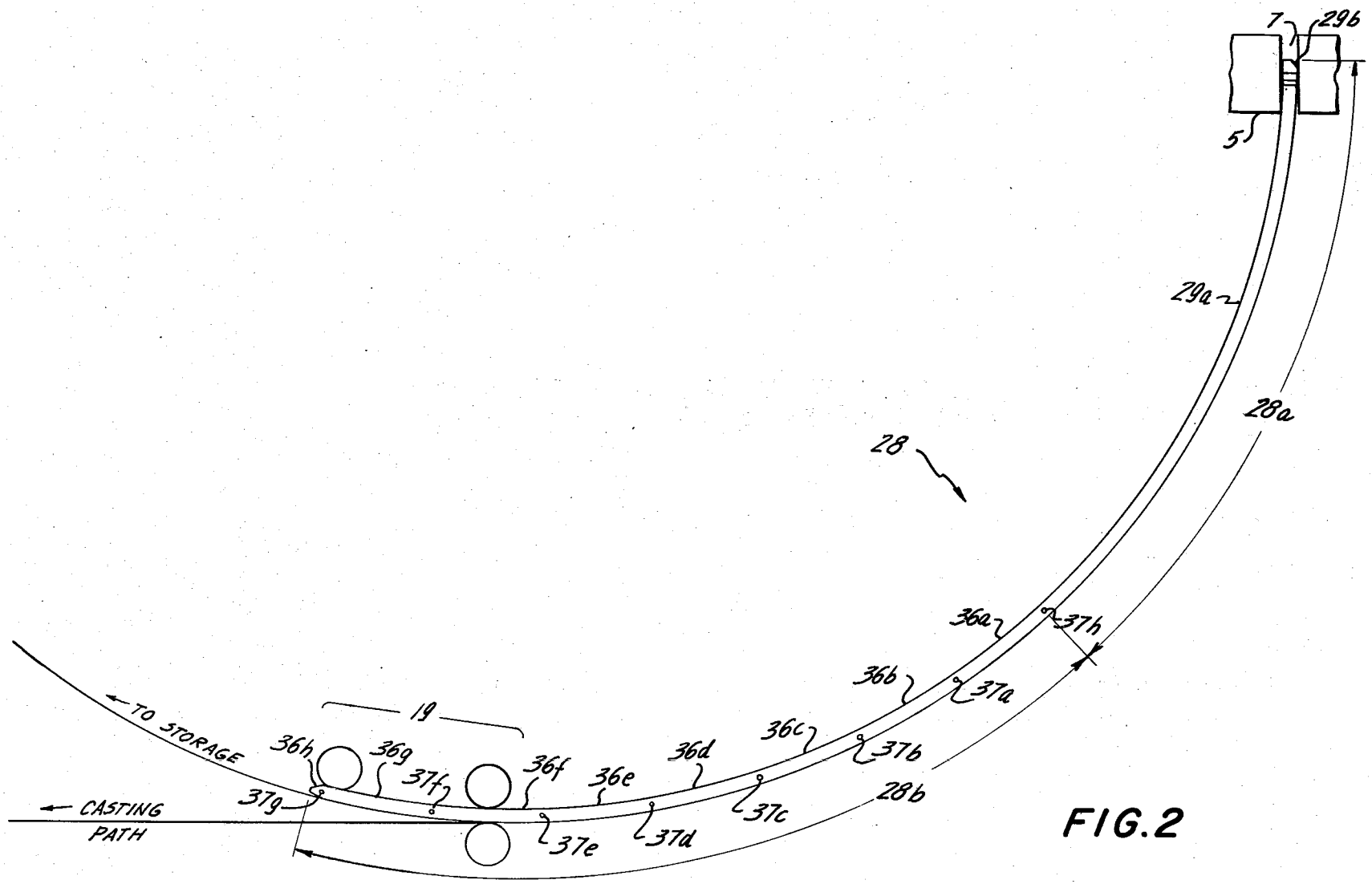
FIG. 2 schematically illustrates the dummy bar positioned in readiness for casting.

A cooled, tubular mold 5 is supported at the level of the casting platform 4 by an oscillator 6. The mold 5 has a generally vertical orientation and, as seen from FIG. 2, is provided with an open-ended, curved casting passage 7. In operation, molten metal is introduced into the upper end of the casting passage 7 and a continuously cast strand is withdrawn from the lower end thereof. The radius of the casting passage 7 defines the casting radius which is the radius of the curved strand formed in the mold 5.

A curved cooling zone 8 follows the mold 5 in the casting direction and has a radius equal to the casting radius. Pipes provided with nozzles are arranged along the cooling zone 8 in conventional manner and serve to spray a coolant, typically water, onto the strand. The pipes and nozzles have not been illustrated for the sake of clarity.

A stand 9 is located in the cooling zone 8 and is mounted on one of the horizontal beams 3 of the support structure for the casting platform 4. The stand 9 carries a guide roller 10.

Figure 3:
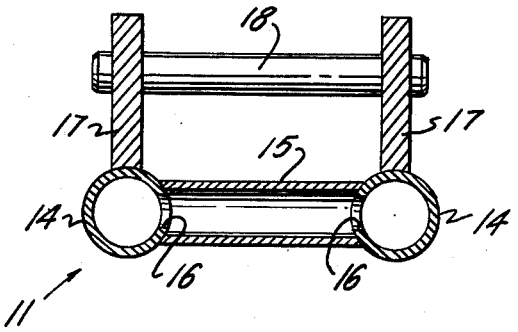
FIG. 3 is a view in the direction of the arrows III—III of FIG. 1.

A support unit 11 is arranged behind the cooling zone 8 in the casting direction and is mounted at its respective ends on a pillar 12 and a beam 13. The support unit 11 is curved and again has a radius equal to the casting radius. As illustrated in FIG. 3, the support unit 11 is made up of a pair of spaced, parallel pipes 14 which extend in the casting direction and are connected at intervals along their lengths by pipe sections 15. The pipes 14 are closed at their ends and are connected with a source of coolant such as water which circulates through the pipes 14. In order that the coolant may also circulate through the pipe sections 15, the pipes 14 are provided with openings 16 via which the coolant may flow from the pipes 14 into the pipe sections 15.

A plate 17 is mounted on edge atop each of the pipes 14. The plates 17 extend in parallelism with one another along the lengths of the pipes 14. Support shafts 18 for the strand are journalled in the plates 17 at intervals along the lengths of the latter.

Referring back to FIG. 1, a straightener 19, which also functions as a withdrawal device, is arranged behind the support unit 11 in the casting direction. The straightener 19 is followed by a torch approach table 20 and a torch mechanism 21. The torch mechanism 21, in turn, is followed by a runout table 22. Since the straightener 19, the torch approach table 20, the torch mechanism 21 and the runout table 22 may all have conventional designs, the details thereof have not been illustrated.

A storage unit is located behind the straightener 19 and above the torch approach table 20. The storage unit is mounted on a support structure 23 which includes a platform 24 carried by vertical beams **25*a* and 25*b*. The platform 24, in turn, carries beams 26*a* and 26*b* and corresponding gussets 27*a* and 27*b*. The storage unit accommodates a dummy bar 28 which closes the lower end of the mold 5 at the beginning of a casting operation and initiates the withdrawal of a continuously cast strand from the mold 5**.

In accordance with the invention, the dummy bar 28 is designed so that, when it is positioned in readiness for casting it behaves much like a rigid dummy bar. One of the primary advantages of a rigid dummy bar as compared to a flexible dummy bar stems from the reduction in support structure required between the mold and the straightener. On the other hand, the dummy bar 28 is designed such that is may be stored more compactly than a rigid dummy bar. In a preferred embodiment, the dummy bar 28 is designed to be stored in such a manner that it does not block access to the straightener 19 and does not project above the casting platform 4 thereby interfering with crane movement.

According to the invention, and as illustrated in FIGS. 1 and 2, the dummy bar 28 is made up of a rigid portion **28*a* and a flexible portion 28*b*. The total length of the dummy bar 28 is such that, when positioned in readiness for casting as in FIG. 2, it extends at least from the mold 5 to the straightener 19 which is schematically depicted by three rollers in FIG. 2. The rigid portion 28*a* of the dummy bar 28 has a length which is less than the distance between the mold 5 and the straightener 19 but is a substantial fraction thereof. On the basis of calculations which have been performed, it has been found that an advantageous length for the rigid portion 28*a* is approximately one-eighth of the circumference of a circle having a radius equal to the casting radius. This is roughly equal to one-half the distance between the mold 5 and the straightener 19**.

Figure 4:
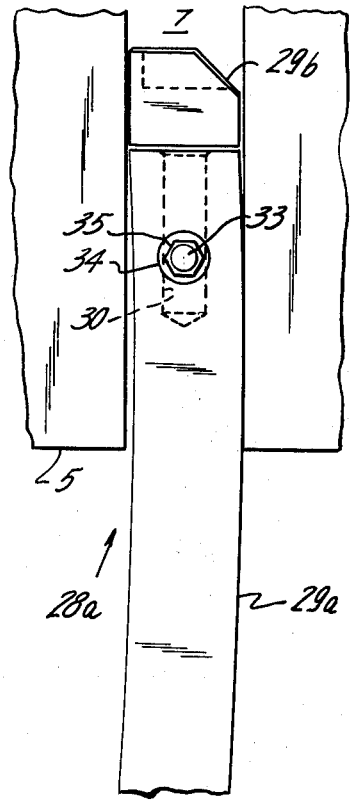
FIG. 4 is an enlarged side view illustrating details of the rigid portion of the dummy bar.

With reference to FIGS. 2 and 4, the rigid portion **28*a* of the dummy bar 28 includes an arcuate segment 29*a* and a dummy bar head 29*b* which is fixedly mounted on the segment 29*a*. The segment 29*a* has a radius equal to the casting radius. Thus, the portion 28*a* of the dummy bar 28 is in the form of a rigid piece conforming to the curvature of the curved part of the casting path between the mold 5 and the straightener 19. The segment 29*a*** is here assumed to have a solid, square cross-section but any suitable cross-sectional configuration may be used.

The dummy bar head **29*b* is illustrated as being of the permanent, quick-disconnect type, that is, of the type which may be used repeatedly and may be disconnected from the strand without interrupting the withdrawal of the latter from the mold 5**. However, it is also possible to use a dummy bar head of the type requiring a disposable connection between the dummy bar head and the strand. Since both types of dummy bar heads are known, details thereof have not been shown.

Figure 5:
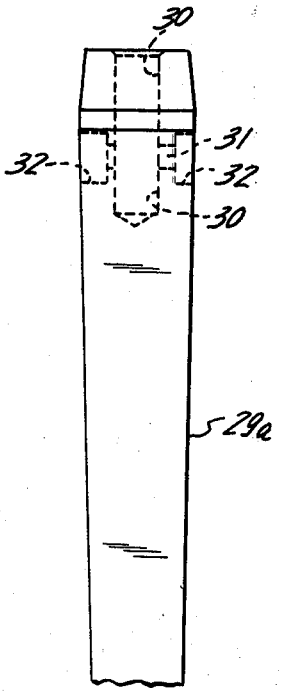
FIG. 5 is an enlarged front view illustrating further details of the rigid portion of the dummy bar.

The connection between the dummy bar head **29*b* and the arcuate segment 29*a* is established in the manner illustrated in FIGS. 4 and 5. The arcuate segment 29*a* is provided with a longitudinal bore 30 in the end thereof adjacent the dummy bar head 29*b*. A transverse passage 31 having enlarged ends 32 intersects the bore 30. The dummy bar head 29*b* has a depending stem which is received in the bore 30 and is provided with a transverse opening arranged to be aligned with the passage 31. A threaded bolt 33 extends into the passage 31 from one side thereof and passes through the opening in the stem of the dummy bar head 29*b* to the other side of the passage 31. The head of the bolt 33 is accommodated in one of the enlarged ends 32 of the passage 31 while the threaded end of the bolt 33 is accommodated in the other enlarged end 32. A washer 34 is fitted over the dummy bar 28 is driven by the straightener 19, the drive mechanism 58 of the storage unit is synchronized with the straightener 19. The guide roller 10 mounted below the mold 5 insures that the dummy bar head 29***b* is in alignment with the casting passage 7 in the mold 5 as the dummy bar head 29*b* approaches the latter. The dummy bar 28 is driven upwardly until the dummy bar head 29*b* is properly positioned in the casting passage 7. The straightener 19, which at this time grips the dummy bar 28 in the vicinity of its terminal link 36*h*, holds the dummy bar 28 in position.

As the dummy bar 28 is fed towards the mold 5, the links 36*a*–36*h* of the flexible portion 28*b* ţ vot so that the flexible portion 28*b* assumes the casting radius. When the dummy bar 28 is positioned in readiness for casting as schematically illustrated in FIG. 2, it defines a smooth arc having a radius equal to the casting radius. In this condition, the dummy bar 28 behaves much like a totally rigid dummy bar in that it need not be supported along the entire span between the mold 5 and the straightener 19. At most, it is necessary to support the flexible portion 28*b* of the dummy bar 28. The support unit 11 fulfills this function and extends from the vicinity of the straightener 19 to approximately the region of the pivot joint 37*h* between the respective rigid and flexible portions 28*a* and 28*b* of the dummy bar 28.

After the dummy bar head 29*b* has been sealed in the mold 5, molten metal is teemed into the mold passage 7 from a non-illustrated teeming vessel such as a tundish. When the molten metal in the mold 5 reaches a predetermined level, the straightener 19 is operated to draw the dummy bar 28 away from the mold 5. The drive mechanism 58 of the storage unit is driven in synchronism with the straightener 19. The terminal link 36*h* of the dummy bar 28 follows a continuation of the curved path defined by the mold 5, the cooling zone 8 and the support unit 11 and thus enters the lower section 48*a* of the storage unit. As the dummy bar 28 continues to be drawn away from the mold 5, it is progressively fed into the storage unit. The flexible portion 28*b* of the dummy bar 28 maintains the casting radius until the terminal link 36*h* of the dummy bar 28 has passed through the lower section 48*a* of the storage unit and enters the upper section 48*b* thereof. At this time, the flexible portion 28*b* begins to assume the smaller radius of the upper section 48*b*. The short length of the terminal link 36*h* allows this to readily follow the rollers 54*a* and 54*b* of the upper section 48*b* thereby facilitating introduction of the dummy bar 28 into the storage unit.

When the dummy bar head 29*b* has left the straightener 19, the latter is operated in conventional manner to straighten the strand so that it will continue along a horizontal path to the torch mechanism 21. This action causes the dummy bar head 29*b* to become disconnected from the strand. Since the straightener 19 no longer acts upon the dummy bar 28, the feeding of the latter into the storage unit is taken over entirely by the drive mechanism 58 of the storage unit. The drive mechanism 58 draws the dummy bar 28 into the final storage position illustrated in FIG. 1. In this position, the flexible portion 28*b* is stored on an arc having a radius substantially smaller than the casting radius thereby reducing the storage area required for the dummy bar 28 as compared to a similar dummy bar which is totally rigid.

Reinsertion of the dummy bar 28 into the mold 5 may be initiated immediately after the strand has cleared the straightener 19. This permits a reduction in the time between casting operations as compared to casting installations where the dummy bar is stored alongside the runout table and reinsertion of the dummy bar into the mold cannot be begun until the strand has cleared the runout table.

As is apparent from FIG. 1, neither the dummy bar 28 nor its storage unit projects above the casting platform 4. Accordingly, the dummy bar 28 does not cause interference with crane movement. Furthermore, neither the dummy bar 28 nor its storage unit projects over the straightener 19. This permits free access to the latter when the casting platform 4 is designed accordingly. Thus, the casting platform 4 may either terminate short of the straightener 19 or may be provided with an opening above the latter.

Preferably, the ratio of the length of the rigid portion 28*a* to that of the flexible portion 28*b* of the dummy bar 28 is maximized within the limitations of non-interference with crane movement and with access to the straightener 19. This minimizes maintenance of the dummy bar 28 since the flexible portion 28*b* requires more maintenance than the rigid portion 28*a* due to the presence of the pivot joints 37*a*–37*g* in the flexible portion 28*b*. Similarly, as a result of maintenance considerations, the lengths of the main links 36*a*–36*g* of the flexible portion 28*b* are preferably maximized within the foregoing limitations in order to minimize the number of pivot joints. However, an upper limit is imposed on the lengths of the main links 36*a*–36*g* in that the flexible portion 28*b* should be able to readily conform to the configuration of the upper section 48*b* of the storage unit.

The flexible portion 28*b* should be capable of assuming a radius so much smaller than the casting radius that the dummy bar 28 and the storage unit will not project above the casting platform 4 and over the straightener 19. The degree of bending required of the flexible portion 28*b*, and hence the radius of the upper section 48*b* of the storage unit, will depend upon various design considerations including the magnitude of the casting radius. As an indication of the relative magnitudes of the casting radius and the radius of the upper section 48*b*, a continuous casting installation having a casting radius of 26 feet may be provided with a storage unit having an upper section 48*b* with a radius of approximately 6 feet.

The following are among the advantages which may be achieved with the dummy bar of the invention:

1. Since only part of the dummy bar is flexible, maintenance requirements are reduced as compared to a dummy bar which is flexible in its entirety.

2. Inasmuch as the rigid part of the dummy bar is essentially self-supporting, less support structure is required between the mold and the straightener than for a dummy bar which is flexible in its entirety.

3. Since the flexible part of the dummy bar may assume a radius substantially smaller than the casting radius, the dummy bar may be stored more compactly than a dummy bar which is rigid in its entirety. This enables interference with crane movement, with the casting platform and with access to the straightener to be reduced or eliminated.

4. Inasmuch as part of the dummy bar is flexible, there is some degree of forgiveness for distortion which might prevent smooth entry into the mold if it occurred in a dummy bar which is rigid in its entirety.

5. Since the dummy bar may conveniently be stored immediately behind the straightener, it is possible to begin reinsertion of the dummy bar into the mold once the strand has left the straightener. This makes it possible to reduce the time between consecutive casting operations as compared to a casting machine where the dummy bar is stored next to the runout table and reinsertion can be begun only after the strand has cleared the runout table. This also enables the runout table of a casting machine having the dummy bar of the invention to be shortened relative to a casting machine where the dummy bar is stored flat alongside the runout table which must then have a length at least equal to that of the dummy bar.

6. Inasmuch as the portion of the dummy bar nearest the strand is rigid, the molten metal which escapes from a strand in the event of a breakout and which is capable of welding a pair of pivotally connected links to one another has little chance of severely damaging the dummy bar.

I claim:

1. A continuous casting installation comprising:

(a) a mold having an open-ended casting passage;

(b) an arcuate cooling zone downstream of said mold having a predetermined casting radius;

(c) a device downstream of said mold for withdrawing a continuously cast strand from said mold;

(d) a dummy bar for initiating the withdrawal of the strand from said mold, said dummy bar having a length at least equal to the distance from said mold to said device, and said dummy bar including a rigid portion and a flexible portion, said rigid portion being arcuate and having a radius equal to said casting radius and a length which is a substantial fraction of said distance, and said rigid portion having an end which closes the outlet end of said casting passage at the beginning of a casting operation and is provided with coupling means for establishing a connection with the strand, said flexible portion being capable of bending to a radius substantially smaller than said casting radius; and (e) storage means for said dummy bar, said storage means comprising a first section for said rigid portion and a second section for said flexible portion, said first section including arcuate first support means having a radius equal to said casting radius and said second section including arcuate second support means having a radius substantially smaller than said casting radius.

2. The installation of claim 1 in which said flexible portion comprises a plurality of arcuate links having radii equal to said casting radius.

3. The installation of claim 2 in which said dummy bar comprises stop means preventing bending of said flexible portion to a radius larger than said casting radius.

4. The installation of claim 3 in which said stop means comprises cooperating abutment surfaces on adjoining ones of said links.

5. The installation of claim 2 in which said links are substantially shorter than said rigid portion.

6. The installation of claim 2 in which the lengths of said links are equal.

7. The installation of claim 2 in which said mold is arranged at a casting platform and said storage means does not exceed the height of said casting platform and does not project over said device, the number of said links being the minimum under the condition that said dummy bar be readily receivable in said storage means.

8. The installation of claim 2 in which said links include a terminal link at the end of said flexible portion remote from said rigid portion, the length of said terminal link being smaller than the lengths of the remainder of said links to facilitate introduction of said dummy bar into said storage means.

9. The installation of claim 1 in which said rigid and flexible portions are pivotally connected with one another.

10. The installation of claim 1 in which the length of said rigid portion approximates one-eighth of the circumference of a circle having said casting radius.

11. The installation of claim 1 in which the length of said dummy bar approximates one-quarter of the circumference of a circle having said casting radius.

12. The installation of claim 1 in which said mold is arranged at a casting platform and said storage means does not exceed the height of said casting platform and does not project over said device.

13. The installation of claim 12 in which the ratio of the length of said rigid portion to that of said flexible portion is the maximum under the condition that said dummy bar be readily receivable in said storage means.

14. The installation of claim 1 in which said first support means lies on an arc which forms a continuation of that defined by said cooling zone.

15. The installation of claim 1 in which substantially no support structure for said dummy bar is provided between said mold and the location at which the connection between said rigid and flexible portions is situated when said rigid portion closes said outlet end of said casting passage.

16. The installation of claim 1 in which said storage means comprises a drive for drawing said dummy bar into said storage means and for controlling the feeding of said dummy bar from said storage means into said device.

17. The installation of claim 1 in which said device is a withdrawal and straightening unit.

18. The installation of claim 1 in which said device is located downstream of said cooling zone.

19. The installation of claim 1 in which the length of said flexible portion is a substantial fraction of said distance.

20. The installation of claim 12 in which said storage means is arranged to store said dummy bar so that the latter is below said casting platform in its entirety and does not project over said device.

* * * * *